United States Patent [19]

Zabner et al.

[11] 4,194,645

[45] Mar. 25, 1980

[54] CONTAINER COVER CONSTRUCTION

[75] Inventors: Adolf Zabner, Warwick; Norman I. Bellemore, Smithfield, both of R.I.

[73] Assignee: Nyman Mfg. Co., East Providence, R.I.

[21] Appl. No.: 950,237

[22] Filed: Oct. 10, 1978

[51] Int. Cl.[2] ..... B65D 41/16; B65D 43/06; B65D 55/00

[52] U.S. Cl. ..... 220/306; 229/43; 220/355; 220/380

[58] Field of Search ..... 220/306, 355, 356, 380; 229/43, 1.5 E; 150/0.5; 206/508

[56] References Cited

U.S. PATENT DOCUMENTS

| | | | |
|---|---|---|---|
| 2,922,563 | 1/1960 | Aldington | 229/43 |
| 3,122,264 | 2/1964 | David | 229/43 X |
| 3,193,130 | 7/1965 | Miller | 220/44 |
| 3,353,708 | 11/1967 | David | 229/43 X |
| 3,583,596 | 6/1971 | Brewer | 229/43 X |
| 3,632,016 | 1/1972 | Bozek | 220/355 X |
| 3,883,036 | 5/1975 | Mahaffy et al. | 229/43 X |
| 4,076,123 | 2/1978 | David | 220/380 X |

*Primary Examiner*—Steven M. Pollard
*Attorney, Agent, or Firm*—Salter & Michaelson

[57] ABSTRACT

A cover for containers and especially of the plastic snap-on type for drinking cups and the like is provided with a downwardly outwardly extending peripheral skirt. The skirt is in turn provided with a plurality of circumferentially spaced radially outwardly directed flutes as well as a plurality of alternatively adjacent inwardly directed detent portions or lands in part defined by the aforementioned flutes. Upper inner surface portions of the lands are adapted to engage the outer peripheral bead of the container which the cover is adapted to close while construction of the flutes simultaneously provides for a degree of limited circumferential expansion so as to accommodate the manufacturing dimensional tolerances in the container bead. The flute construction also enables major portions of the skirt to be upwardly outwardly flexed to further accommodate such dimensional variations.

3 Claims, 6 Drawing Figures

CONTAINER COVER CONSTRUCTION

BACKGROUND AND SUMMARY OF THE INVENTION

This invention is directed to covers or lids, especially those formed from sheets of plastic material and adapted for snap-on closure for drinking containers and the like. Normally such containers include an upper terminal curled wall portion or bead adapted for receipt in a similarly configured channel provided in the cover. Such cover construction normally includes a peripheral terminal skirt which may include a plurality of circumferentially spaced inwardly directed detents such as those designated by the reference numeral 14 in U.S. Pat. No. 3,193,130 issued July 6, 1965. Similar detents are described in U.S. Pat. No. Re. 28,797 reissued May 4, 1976 and designated by reference numeral 23 therein. In both the above-indicated constructions, the upper inner surface portions of the detents are adapted to engage outer peripheral portions of the container bead and are generally configured so as to be of decreasing circumferential dimension in the upward direction. The above patent citations and the discussion thereof constitutes applicant's Prior Art Disclosure and in that regard, a copy of each such patent is enclosed with this application.

Although the constructions set forth in such above-identified patents are functional and in fact represent commercially acceptable products, it would be desirable to provide a cover construction which more easily will expand, deflect or otherwise accommodate slight variances in the bead dimensions of the container under consideration. It is accordingly a primary object of the present invention to provide a cover construction of the type hereunder consideration which will simultaneously more readily circumferentially expand and radially outwardly flex to accommodate such minor manufacturing dimensional changes that may occur in the beads of such containers.

This and other objects of the present invention are accomplished by a provision of a cover construction in which alternating inwardly directed detents and outwardly directed flutes are formed in a downwardly extending peripheral skirt portion. The deepest part of each detent is located at the base thereof and the detents are so oriented that they are of generally equal width, i.e. circumferential dimension along their vertical extent. Similarly, the flutes are of generally equal width and merge with the skirt adjacent lower portions of the channel in a relatively short, straight, horizontally extending portion. Such horizontally extending portions cooperatively form an interrupted peripheral base line about which the skirt may upwardly flex when the container bead is positioned within the channel. Thus by dimensioning alternating flutes and detents in a manner significantly different from that which is shown as conventional in the above-referred to patents, applicants have devised a novel container cover construction which operates in an improved manner.

Other objects, features and advantages of the invention shall become apparent as the description thereof proceeds when considered in connection with the accompanying illustrative drawings.

DESCRIPTION OF THE INVENTION

In the drawings which illustrates the best mode presently contemplated for carrying out the present invention:

DESCRIPTION OF THE INVENTION

Figure 1:
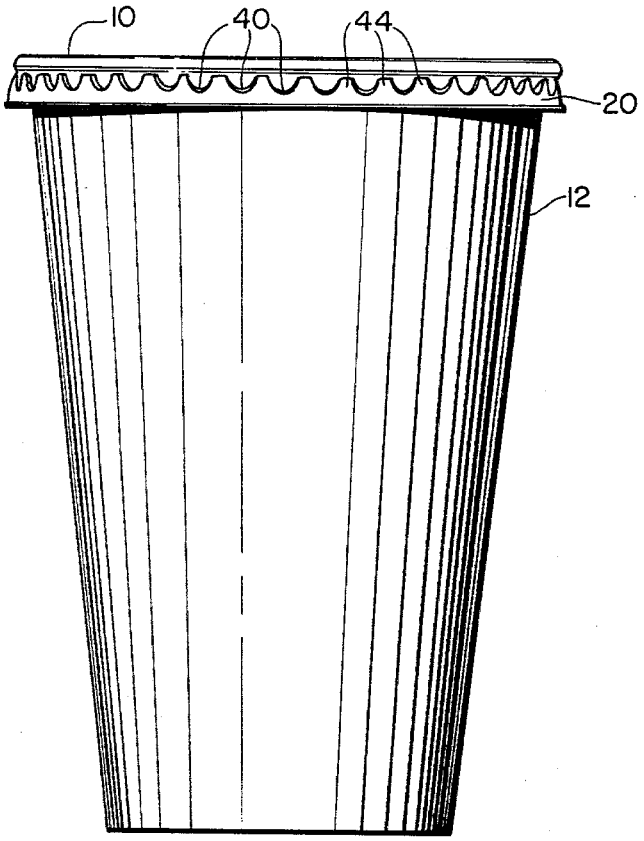
FIG. 1 is an elevational view of a container having a cover constructed in the manner of the present invention attached thereto.
Figure 2:
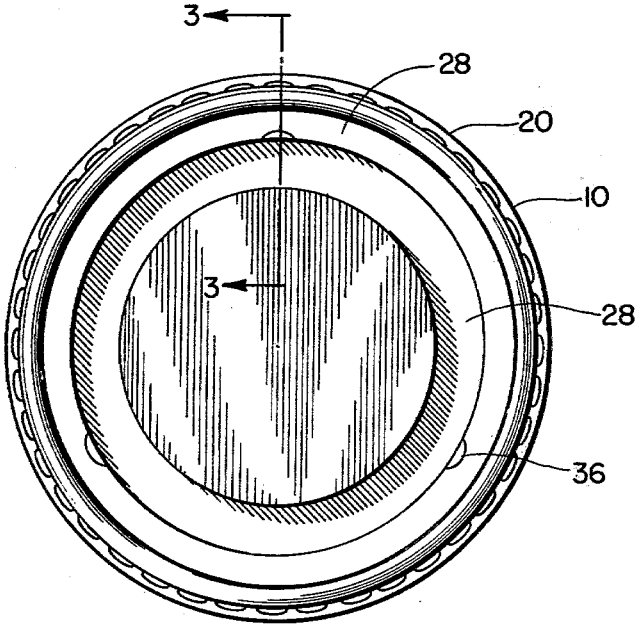
FIG. 2 is a top plan view thereof.
Figure 3:
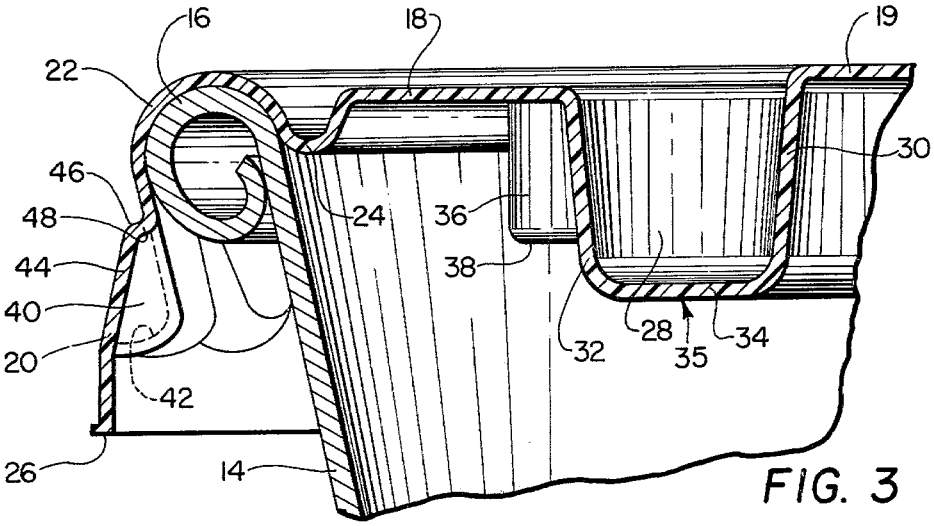
FIG. 3 is a sectional view taken along the line 3—3 of FIG. 2.
Figure 4:
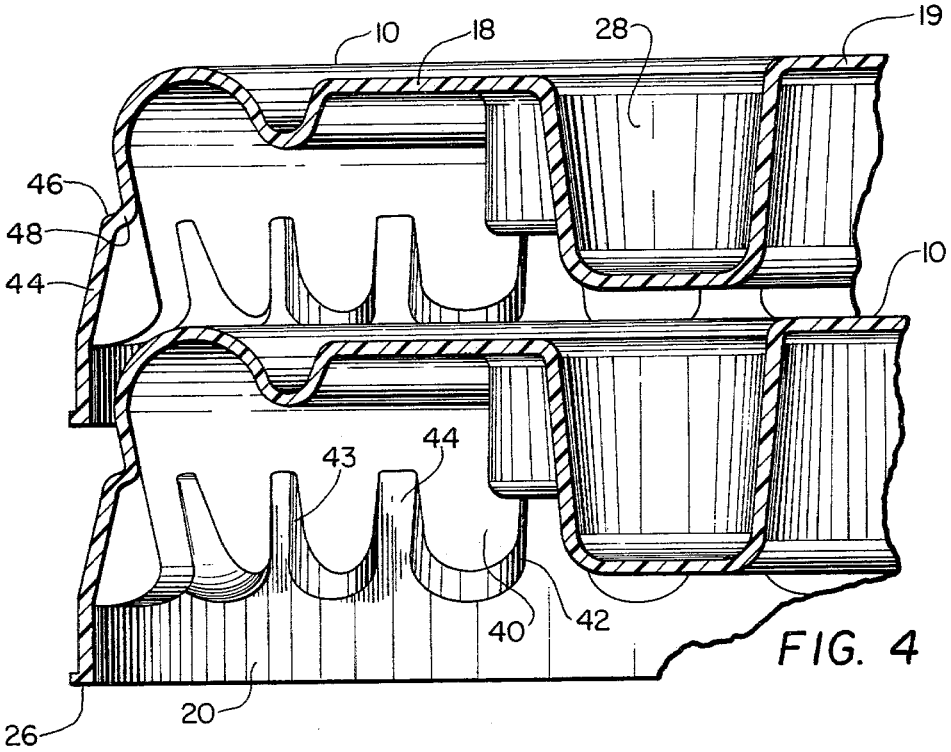
FIG. 4 is a sectional view showing two covers just prior to being stacked upon each other and illustrating the stacking feature of the invention.
Figure 5:
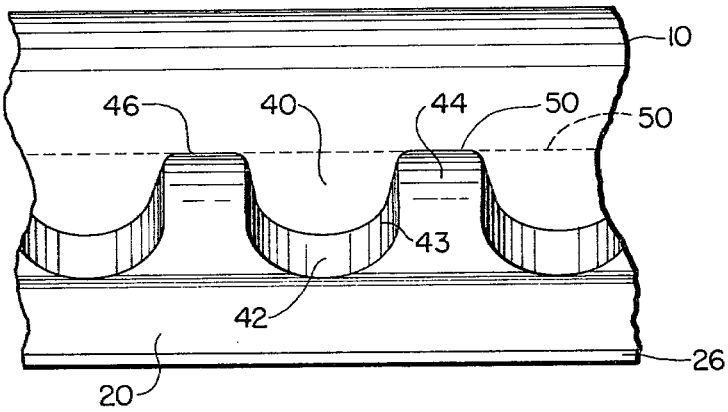
FIG. 5 is a partial side view of the cover.

Referring to the drawing and particularly FIGS. 1 and 3 thereof, the cover 10 of the present invention is shown disposed upon the open end of a container 12. Generally, the container includes sidewalls 14 which terminate in an outwardly curled edge or bead 16 generally of somewhat circular configuration. The container may be formed from any suitable material such as thermoformed plastic sheet, treated paper and the like, and may be suitable for the containment of various comestibles and the like including hot or cold liquids.

The cover 10 on the other hand is of generally disc-like configuration having a top panel 18 including a central portion 19. A peripheral skirt 20 is connected to the top panel 18 by means of an intermediate inverted peripheral channel 22 adapted to receive the peripheral bead 16 of the container 12. A downwardly directed seating rib 24 is disposed inwardly adjacent of the channel 22 and serves to insure contact with inner portions of the container sidewalls 14 and to some extent stiffen the top panel 18.

Figure 6:
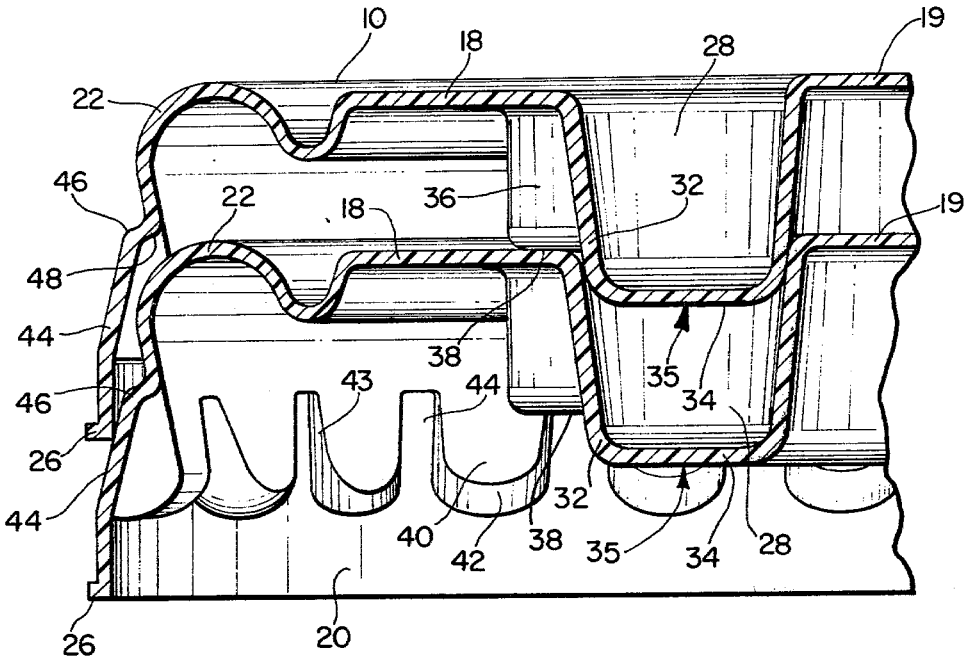
FIG. 6 is a sectional view similar to FIG. 4 showing two of the covers in stacked position.

The terminal edge 26 of the skirt 20 terminates radially outwardly of the outer radial extent of the channel 22 such that a plurality of covers may be stacked one upon each other as shown in FIG. 6. Furthermore, the top panel 18 is provided with a downwardly directed annular recess 28 including a vertically directed inner wall 30, a vertically directed outer wall 32 and a generally horizontally directed connecting wall 34, the walls 30, 32 and 34 defining a depending annular projection 35. Joined to the outer wall 32 in spaced apart relation are at least two and generally a plurality of radially outwardly directed detents 36 which serve as stacking lugs and include bottom surfaces 38 that contact portions of the top panel 18 of another cover or lid 19 superimposed therewith during stacking of adjacent covers or lids. Thus, in the stacking of the covers during storage or shipping as illustrated in FIG. 6 contact between the top panel 18 and the surfaces 38 of adjacent covers or lids prevents the stacked lids from telescoping into each other to an extent that would render their subsequent separation difficult. It is also seen that during stacking the recess 28 defines means for positively locating the annular projection 35 as defined by the walls 30, 32 and 34.

The skirt 20 is provided with a plurality of circumferentially spaced radially inwardly directed detents 40 of generally U-shaped configuration. The base 42 of each detent 40 is disposed most radially inwardly of the remaining portions of the detent including generally triangular sidewalls 43 upwardly merging into the channel 22 at the lower extent thereof. Disposed alternatively between each of the detents 40 is a flute 44 which is radially directed with respect to the detents 40 is a flute 44 which is radially directed with respect to the detents 40 and at least in part defined by the sidewalls 43 adjacent thereto. Each of the flutes 44 terminates in a relatively short, straight, upper horizontally extending portion 46 which terminates at the lower extent of the channel 22. Portion 46 also preferably forms a radially outwardly offset ledge 48 and thus merges with the channel in an abrupt manner rather than smoothly merging therewith for a purpose which will hereinafter be more apparent.

It may thus be seen that the horizontally extending portions 46, i.e. the ledges 48, cooperatively form a base line 50 which circumferentially extends about the cover and additionally serves to define the demarcation between the channel 22 and the skirt 20. Such base line is interrupted as shown by the dotted line portions extending across the detents 40. Accordingly, when the peripheral bead 16 of the container is disposed within the channel 22, it will be apparent that the inner surface portions of the detents 40 will be disposed adjacent to or in contact therewith so as to provide a firm engagement therewith at spaced circumferential surface areas about the cover. In this regard, the detents may also be considered lands into which the circumferential extent of the channel 22 may be extended by the circumferential expansion of the flutes 44 by the distortion of the sidewalls 43 in part defining such flutes, that is, by their displacement at a lesser included angle so as to accommodate slight variations or bulges in the dimensions of the bead 16. Similarly, variations of a somewhat increased overall bead diameter can be accommodated by the upward flexing of the skirt 20 about the base line 50. In this connection it should be pointed out that the relatively short abrupt flute portions 46 which serve to in effect connect the skirt 20 to the bead 16 also will form a hinge line about which the skirt may be deflected to accommodate minor peripheral enlargements of the bead.

It will thus be apparent that the objectives of the present invention are accomplished by the provision of an unique cover construction which is believed unobvious from the prior art constructions.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A cover for containers having an external peripheral bead at an upper edge thereof, said cover being formed of an easily flexed material and comprising a top wall, a downwardly extending peripheral skirt, and an inverted peripheral channel connecting said skirt to said top wall and for receiving said peripheral bead of an associated container, said skirt including a plurality of peripherally spaced inwardly directed generally U-shaped detents and a plurality of peripherally spaced flutes disposed between and in part defined by adjacent portions of said detents, said flutes terminating in a relatively straight, upper horizontally extending portion cooperatively forming an interrupted peripheral base line positioned radially adjacent the outer lower extent of said container bead receiving channel and about which said skirt may outwardly flex when said container bead is positioned within said channel with upper inner surface portions of said detents in contact therewith, said upper horizontally extending portions radially outwardly offset from circumferentially adjacent portions of said detents, said detents being most deeply inwardly directed at the bottom portions thereof and gradually upwardly extending so as to merge with said lower extent of said container bead receiving channel along said peripheral base line such that the upper extent of both detents and said flutes coextensively terminate at said peripheral base line.

2. The cover construction of claims 1, said top wall having a downwardly directed annular recess having a relatively vertically directed wall and a connecting wall, said vertically directed wall having at least a pair of circumferentially spaced radially extending stacking lugs.

3. The cover construction of claim 2, said recess having a vertically directed outer wall and a vertically directed inner wall, said connecting wall being horizontally directed and connecting said other walls at base portions thereof, said lugs radially outwardly extending from said outer walls.

* * * * *